United States Patent [19]

Lahiff

[11] Patent Number: 4,711,397

[45] Date of Patent: Dec. 8, 1987

[54] ELECTROMAGNETIC FUEL INJECTOR HAVING CONTINUOUS FLOW PATH

[75] Inventor: John E. Lahiff, Farmington, Mich.

[73] Assignee: Essex Group, Inc., Fort Wayne, Ind.

[21] Appl. No.: 338,799

[22] Filed: Jan. 11, 1982

[51] Int. Cl.[4] ..... F02M 53/04

[52] U.S. Cl. ..... 239/125; 239/585; 251/129.21; 251/129.22

[58] Field of Search ..... 239/124, 125, 584, 585; 123/472, 516; 251/129.21, 129.22

[56] References Cited

U.S. PATENT DOCUMENTS

| | | | |
|---|---|---|---|
| 3,669,361 | 6/1972 | Gueret | 239/585 |
| 4,218,021 | 8/1980 | Palma | 239/585 |
| 4,292,947 | 10/1981 | Tanasawa et al. | 123/472 |
| 4,341,193 | 7/1982 | Bowler | 123/516 |
| 4,354,640 | 10/1982 | Hans | 239/585 |

*Primary Examiner*—Andres Kashnikow

*Attorney, Agent, or Firm*—Stephen A. Schneeberger

[57] ABSTRACT

An electromagnetically operated fuel injection valve structured to include a housing having a fuel inlet opening, a fuel discharge opening and a fuel return opening, there being a continuous liquid path from the inlet opening to the return opening and an intermittent, or valved, liquid path from the inlet opening to the discharge opening. The continuous liquid path has a slope, in the direction of flow toward said return opening, which preferably is always 0 or positive relative to a horizontal axis or plane. A discharge valve is provided in the injector and exists in the valve path. The discharge valve is connected to an armature which is in turn actuated by a solenoid comprised of a coil, a tubular bobbin and an electromagnetic frame. The frame has a vertical tubular core portion and an upper flange extending outwardly therefrom. The coil is disposed on the bobbin and the bobbin is coaxially disposed about the frame core portion below the flange. The flange, and preferably also the core of the frame include a slot or opening extending therethrough. The continuous liquid path extends upwardly through the frame tubular core and, in parallel, through the opening in the upper flange.

6 Claims, 3 Drawing Figures

ELECTROMAGNETIC FUEL INJECTOR HAVING CONTINUOUS FLOW PATH

TECHNICAL FIELD

The invention relates to fuel injectors and more particularly to electromagnetically operated fuel injection valves for internal combustion engines.

BACKGROUND ART

In the quest to improve fuel economy, increase performance and/or reduce various emissions of internal combustion engines, there has been considerable development of fuel injectors, and particularly electromagnetically operated injectors for spark-ignited engines. One relatively common provision is that of delivering excess liquid fuel to the injector, and returning the unused portion of the fuel to the fuel tank for reuse. This provision is often made to impart a swirling motion to the fuel prior to opening the valve and injecting the fuel into the engine, as discussed in U.S. Pat. No. 3,241,768 issued to Croft and in U.S. Pat. No. 4,179,069 issued to Knapp et al. In U.S. Pat. No. 4,232,830 to Casey et al, fuel entering the injector is "circulated through the interior of the injector jacket", presumably for subsequent injection and possibly for component-cooling purposes, and the remainder is returned to the fuel tank.

However, in addition to the aforementioned reason for returning a portion of the fuel from the injector to the fuel tank, further advantages may be derived if that return-fuel can also transport vapors from the injector. Such vapors are often formed in the region of the valve and the spray nozzle as a result of the engine heat. These vapors may inhibit the accurate metering of fuel to the engine.

The aforementioned Knapp et al patent provides a path for returning fuel from the injector to a tank only while the valve is closed. However, when the valve is open that return path is closed. This intermittent opening and closing of the return path introduces undesirable pressure pulses at the valve, particularly if a pressure regulator is located in the fuel line downstream of the injector.

The injectors of the aforementioned Croft and Casey et al patents each provide a flow path which is continuous from the injector inlet to the return outlet, even during an open-valve condition. However, the geometry and sizing of those paths is not well suited to the removal of vapors from those injectors.

Accordingly, it is a principal object of the present invention to provide a fuel injector having a continuous fuel return path for effectively and substantially completely removing vapors from the injector.

It is a further object of the invention to provide such a continuous fuel return path which additionally cools the magnet motor of an electromagnetic operated injector.

In accordance with the present invention, there is provided an electromagnetically operated fuel injection valve structured to include a housing having a fuel inlet opening, a fuel discharge opening and a fuel return opening, there being a continuous liquid path from the inlet opening to the return opening and an intermittent, or valved, liquid path from the inlet opening to the discharge opening. The injector is intended for use in a predetermined spatial orientation with an internal combustion engine and the return opening is located to be elevationally at least as high as the remainder of the continuous liquid path to facilitate removal of vapor appearing in the injector. The continuous liquid path has a slope, in the direction of flow toward said return opening, which preferably is always 0 to positive relative to a horizontal axis or plane.

A discharge valve is provided in the injector and exists in the valved path. The continuous path and the valved path coincide between the inlet opening and the valve. The valved path also has a slope which is preferably always 0 or positive relative to a horizontal axis or plane, viewed from the discharge opening toward and to the region of coextensively of the paths. The continuous path and the valved path are sized such that the liquid flow in the continuous path when the valve is closed is preferably at least 1.5–2 times that in the valved path when the valve is full open for adequate removal of generated vapors, yet is not so great as to cause excessive weathering of the fuel.

The discharge valve is connected to an armature which is in turn actuated by a solenoid comprised of a coil, a tubular bobbin and an electromagnetic frame. The frame has a vertical tubular core portion and an upper flange extending outwardly therefrom. The coil is disposed on the bobbin and the bobbin is coaxially disposed about the frame core portion below the flange. The flange, and preferably also the core of the frame include a slot or opening extending therethrough. The continuous liquid path extends upwardly through the frame tubular core and, in parallel, through the opening in the upper flange. In a preferred embodiment, the return opening in the housing is located coaxially above the tubular frame of the solenoid.

BEST MODE FOR CARRYING OUT THE INVENTION

Figure 1:
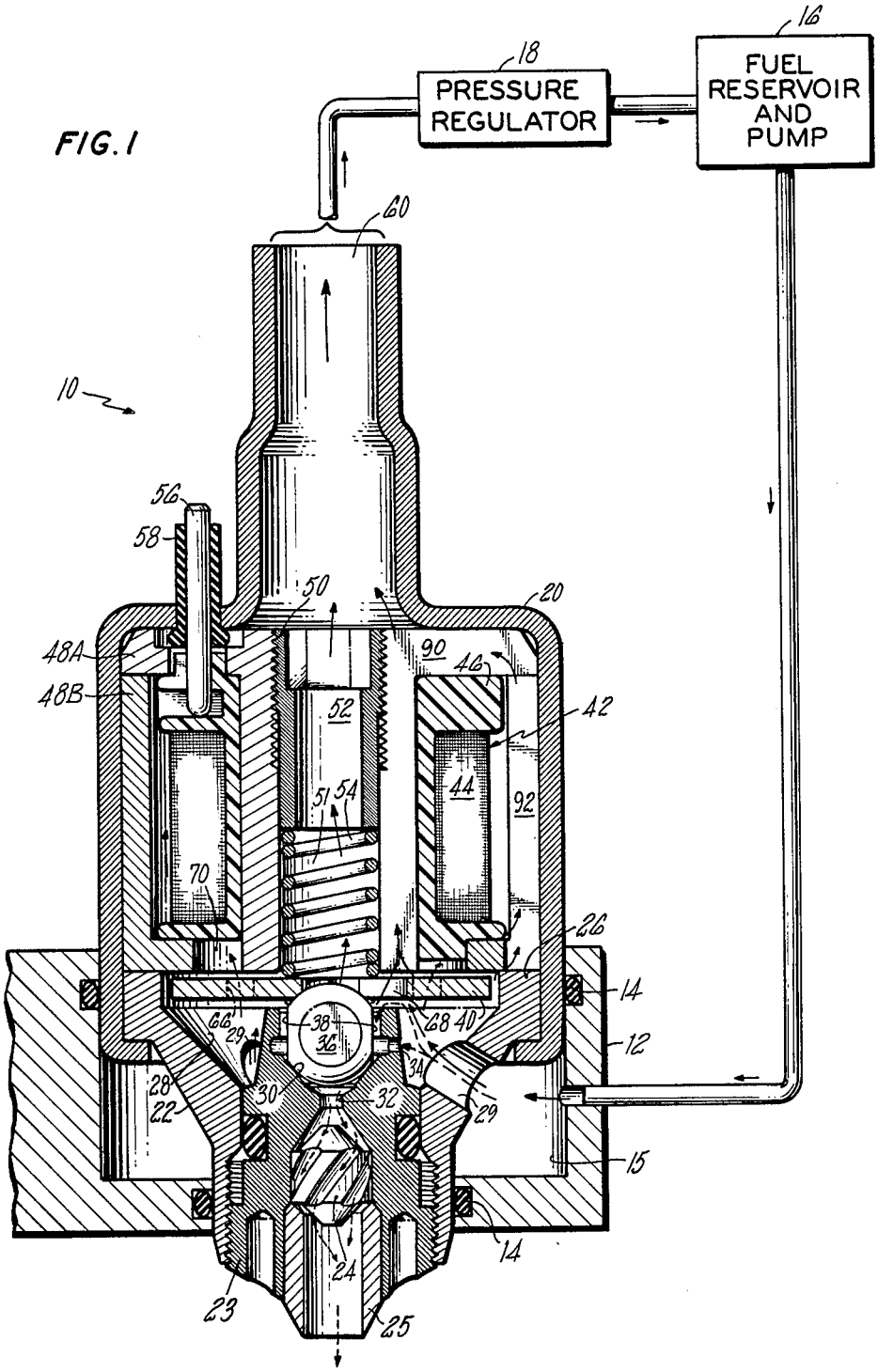
FIG. 1 is an elevational sectional view of a fuel injection valve in accordance with the invention and depicted diagrammatically in use on an internal combustion engine.

Referring to FIG. 1 there is illustrated an elevational sectional view of a fuel injector 10 in accordance with the present invention. Fuel injector 10 is depicted diagrammatically in use on an internal combustion engine. Specifically, the fuel injector 10 is operatively positioned within a mounting jacket 12 associated with the induction portion of an engine. The spatial orientation of the fuel injector 10 when mounted in the jacket 12 has particular significance to the invention as will hereinafter become apparent. The fuel injector 10 is of generally tubular configuration and for purposes of this description will be assumed to be in a substantially vertical orientation. The lower end of the fuel injector 10 is embraced within the jacket 12 via a pair of O-ring seals 14 which create an annular fuel pocket 15 near the base of the injector 10.

Fuel, such as gasoline for a spark-ignited internal combustion engine, is supplied under pressure in excess quantity to the fuel pocket 15 and subsequently to injector 10 from a fuel tank or reservoir and pump 16. In accordance with the invention, a certain portion of that fuel is returned from the injector 10 via a pressure regulator 18 to the fuel tank or reservoir and pump 16 where it is again available for delivery to the injector. The fuel delivered to injector 10 may be at a relatively high pressure, e.g. 30–50 psi or at a relatively low pressure, e.g. 10–20 psi, as predetermined by the characteristics of the system.

Referring now to the fuel injector 10 in greater detail, a generally elongated tubular housing is provided by a tubular housing member 20 of a nonmagnetic material, a valve container ring 22 and a valve body assembly comprised of a valve body 23, a swirl disk 24 and an exit nozzle 25. The housing member 20 comprises the upper half or two-thirds of the injector housing, with the lower remaining portion being formed by valve container ring 22 and the valve body assembly. The housing member 20 includes a lower portion of relatively large diameter and an upper portion of relatively smaller diameter. The lower end of housing member 20 is deformed inwardly to provide an upwardly facing flange which engages a downwardly facing shoulder on an annular rim 26 of the valve container ring 22 to axially retain the container ring.

The diameter of the annular rim 26 of ring 22 is sized for close-fitting insertion into the housing member 20. A first conically-inwardly tapered section of container ring 22 depends from rim 26, followed by a second lower substantially cylindrical section.

The valve body 23 is a generally tubular member which is threadedly inserted into and retained within the lower cylindrical section of the valve container ring 22. The valve body 23 includes an upper portion which extends within the conically-walled section of the valve container ring 22 in spaced relation therewith to form an annular fuel chamber 28 therebetween. One or more ports 29 extend through the conical wall of valve container ring 22 to provide an inlet opening and flow path for the fuel from the pocket 15 in the jacket 12 to the chamber 28 within ring 22.

The valve body 23 includes a central bore which is cylindrical at its upper end and is tapered conically inward therebelow to form an annular valve seating surface 30 and, further below, provides a cylindrical metering orifice 32 of relatively small diameter. This central bore in valve body 23 extends through the length thereof and, below metering orifice 32, opens to a discharge region having spray pattern forming means including a swirl disk 24 maintained within the bore of valve body 23.

Fuel from reservoir 28 is admitted to the bore within valve body 23 by means of one, or preferably a plurality, of ports 34 extending either tangentially or radially through the valve body 23 above the valve seat 30. An additional path for fuel flow from reservoir 28 into the central bore in valve body 23 may be over the uppermost end of the valve body. A ball valve element 36 is positioned within the uppermost bore in valve body 23 and cooperates with the valve seating surface 30 to prevent or allow the flow of fuel from reservoir 28 and ports 34 for discharge to the engine via the metering orifice 32, the swirl disk 24 and the exit nozzle 25. The ball valve 36 may include a plurality of flats 38 peripherally about its midregion for the purpose of reducing its mass and providing flow paths. Typically, the diameter of the central bore in the uppermost portion of valve body 23 is only slightly larger than the outer diameter of the non-flattened portions of the ball valve 36 to limit the lateral motion of the valve element.

The ball valve 36 is attached, as by welding, to a flat-faced washer-shaped armature 40 of magnetic material such as steel. The armature 40 comprises part of an electromagnetic motor or solenoid 42 which is concentrically housed within housing member 20. The solenoid 42 selectively controls the axial positioning of armature 40 and thus ball valve 36 to allow or prevent the discharge of fuel from injector 10 into the engine.

The solenoid 42 is entirely contained within the large diameter lower portion of housing member 20 and includes a wire coil 44 disposed coaxially on a tubular, nonmagnetic spool or bobbin 46 which is in turn coaxially disposed between the radially inner and outer annular sections 48A and 48B of an annular magnetic frame 48. The outside diameter of the magnetic frame 48 is only slightly less than that of the inside diameter of the large diameter portion of housing member 20 for close fitting location therewithin. The inner section 48A of the magnetic frame 48 includes a cylindrical, fluid-passing bore 51 extending coaxially therethrough and into the top end of which is threadedly inserted a tubular spring adjuster 50. The spring adjuster 50 includes a fluid-passing bore 52 extending coaxially therethrough. A helical compression spring 54 is positioned coaxially within the central bore of magnetic frame 48A axially intermediate and in opposing contact with the lower end of spring adjuster 52 and the upper surface of armature 40 to apply a downward, or closing, biasing force to the upper surface of armature 40 and thus ball valve 36. The lower end of spring adjuster 52 engages the upper end of spring 54, and adjustment of the axial positioning of adjuster 52 is used to vary the biasing force applied by spring 54 to the ball valve 36.

The ends of the electrical coil 44 are connected (not shown) to a respective pair of terminals 56 (only one being shown). The terminals 56 are mounted in the top of bobbin 46 and extend upwardly therefrom through openings in the shoulder of the housing member 20 for connection with a source of controlled electrical power. Respective grommets 58 (only one being shown) coaxially surround the respective terminals 56 and extend through the respective openings in the shoulder of housing member 20 to electrically insulate the terminals from the housing and to provide a fluid seal between the interior and exterior of the housing.

The valving action of injector 10 is obtained in a known manner by applying an electrical potential to terminals 56 and thus the electromagnetic motor 42, to magnetically attract the armature 40 and thus the ball valve 36, upwardly against the bias force of spring 54, thereby creating an annular gap between the ball valve and the seating surface 30 to permit discharge of fuel from injector 10 into the engine.

In accordance with the invention, a significant portion of the fuel admitted to injector 10 via one or more inlet ports 29 continuously bypasses the valve 36 and is instead returned to the fuel reservoir and pump 16 via a return outlet opening 60 at the uppermost end of the housing member 20. This continuous fuel flow path from the inlet 29 to the return outlet 60, represented by solid arrows, is afforded through several regions of the injector 10 and serves the important function of removing substantially all vapors which form and might accumulate within the injector, and particularly the moving portions of the injector. Such vapors typically are formed by vaporization of the fuel caused by the high operating temperatures, particularly in the discharge region of the injector. Moreover, by maintaining a continuous flow of fuel in the bypass path even when the ball valve 36 is open, fuel pressure excursions in the fuel delivery system are moderated. More specifically, the fuel pressure regulator 18 is allowed to continuously establish and maintain the pressure of the fuel supplied to the valve for subsequent discharge to the engine.

Both the valved fuel path, represented by broken-line arrows, and the continuous bypass fuel path are coincident for a short distance from the inlet port 29 to the region of valve 36. Thereafter, the valved fuel path extends generally downwardly through metering orifice 32 and the discharge opening formed by exit nozzle 25, whereas the continuous bypass path extends generally upwardly through injector 10 and exits at return opening 60. These two flow paths are configured, however, such that their respective slopes are of the same general sense relative to a horizontal axis or plane to avoid vapor traps that would otherwise be created by a reverse curvature in either of the flow paths. Moreover, the elevationally uppermost part of the region of coincidence of the two flow paths, generally in the area of the upper half of ball valve 36 in the illustrated embodiment, is as high or higher than the remainder of the valved path such that vapors formed therein may find their way to the bypass path for removal via return opening 60.

Figure 2:
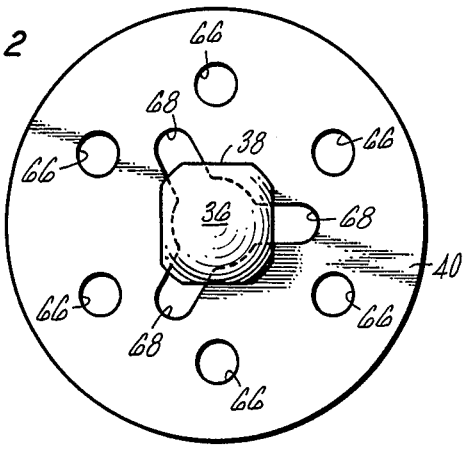
FIG. 2 is an isolated underside view of the armature and ball-valve subassembly.

The structure of the magnet motor 42, the armature 40 and the ball valve 36 will be considered in somewhat greater detail to obtain a better understanding of the continuous fuel flow path(s) extending from the inlet port 29 to the return opening or port 60 of injector 10. Referring to FIG. 2, there is illustrated an underside view of the armature 40 in which a circular opening in the center of the armature is occluded by the upper end of ball valve 36. The central opening in armature 40, however, includes three equiangularly spaced, radially-outwardly extending lobes 68 which are not occluded by ball valve 36. Moreover, armature 40 additionally includes six circular openings 66 equiangularly spaced around its center and extending axially therethrough. The purpose of the openings 66 and 68 is twofold, the first being to provide bidirectional flow of the fuel through the armature 40 to facilitate rapid axial movement during opening and closing of the valve. The second function is to afford a continuous flow path from the reservoir 28 and the upper interior region of valve body 23 through the armature 40 and ultimately out through the return opening 60 in the injector housing, whether the valve is open or closed.

The positioning of the lobe openings 68 is such that fuel may continuously flow from beneath armature 40 into the axial bore through the center of the magnetic frame 48 and the adjuster 52. The positioning of the openings 66 is such that they are at least partially in registry with the annular gap 70 formed between the inner diameter of the inwardly turned base of the outer frame member 48B and the outer diameter of the axially extending core of the inner frame member 48A. Additionally, when the ball valve 36 is seated on valve seat 30, the upper surface of armature 40 is spaced from the under surface of the inwardly turned flange of outer magnetic frame 48B by about 0.1 millimeters such that an additional flow path is provided to the annular gap 70 over the outer periphery of the armature 40.

Figure 3:
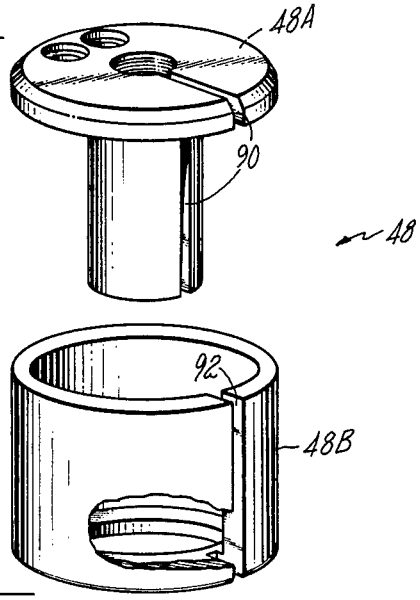
FIG. 3 is an isolated view of the slotted electromagnetic frame of the solenoid, exploded to reveal the slotting therein.

Referring to FIGS. 1 and 3, although the major continuous fuel flow path is upwardly through the center of the injector 10, some parallel paths may also be advantageously provided radially outward thereof through the region of the magnet motor 42. For instance, the inner magnetic frame is a tubular T-shaped member having a slot 90 extending radially through one side of the member for its full axial length including the upper flange. Similarly, the outer magnetic frame 48B is cup-shaped and includes an axially extending portion situated between the outside of coil 44 and the inside surface of housing member 20. The base of magnetic frame member 48B is bent radially inwardly to form a confronting surface which limits the upward travel of armature 40. The outer frame 48B additionally includes a slot 92 extending radially through one side of the full length of the axial wall. The slot 92 does not, however, extend through the radially inwardly turned base of frame 48B in order to insure mechanical integrity in the region of contact with armature 40.

One function of the slots 90 and 92 in magnetic frame members 48A and 48B respectively is the minimization or prevention of the shorted turn effect in the magnetic circuit to reduce the response time of the magnetic circuit to an electrical control stimulus. However, the slots 90 and 92 additionally serve to permit and/or facilitate the flow of fuel in closer proximity with the magnet motor 42. Specifically, the slot 90 in the axial leg of frame 48A affords a narrow flow path along the inner diameter of the spool 46. Moreover, the coil 44 and bobbin 46 of the magnet motor 42 are spaced radially from the outer axial leg of magnetic frame 48B, and fuel may enter that space via the annular gap 70 and beneath the spool 46 where it rests on the inwardly turned flange of frame 48B. That latter region of contact is sufficiently irregular that some fluid passage is afforded. Fuel flowing in this annular space between the magnet motor 42 and the axial leg of frame member 48B is effective in reducing the temperature of the coil 44 and for transporting vapors. That fuel may then exit from the region of the magnet motor 42 via the slot 90 in the flange portion of the magnet member 48A, whereupon it merges with the central, or axial, flow path and subsequently exits from injector 10 at return opening 60.

As previously mentioned, a significant portion of the fuel admitted to injector 10 is bypassed and returned to reservoir and pump 16 via opening 60, even during the intervals when the valve is open and fuel is being injected into the engine. More specifically, the continuous bypass flow path, or paths, are cross-sectionally sized such that cumulatively there is minimum restriction to flow relative to the valved flow path. Typically, the metering orifice 32 and the annular gap about ball valve 36 will constitute the maximum restrictions to flow in the valved path. Moreover, the continuous path and the valved path are relatively sized and configured such that the flow in the continuous path is always sufficiently greater than the static flow in the opened valve path to provide effective system vapor purging. These relative geometries are preferably such that the liquid flow in the continuous path when the valve is closed is at least about 1.5–2 times that in the valved path when the valve is fully open. The other limit to this ratio is determined by factors such as pump capacity, injector size overall and importantly, the avoidance of excessive weathering of the fuel by which certain desirable volatile agents in the fuel are lost due to heating from recirculation.

Although this invention has been shown and described with respect to detailed embodiments thereof, it will be understood by those skilled in the art that various changes in form and detail thereof may be made without departing from the spirit and scope of the clained invention.

I claim:

1. A fuel injector for use in a predetermined spatial orientation with an internal combustion engine, said injector comprising;

substantially tubular housing means having a fuel inlet opening, a fuel discharge opening and a fuel return opening, a continuous liquid path within said housing from said inlet opening to said return opening and a valved liquid path from said inlet opening to said discharge opening;

electromagnetic motor means supported within the housing means and including an armature, a coil, an electromagnetic frame and a tubular bobbin, said frame including at least a substantially vertically extending tubualr core portion and an upper flange extending radially outward therefrom, said coil being concentrically disposed about said bobbin and said bobbin being concentric with the axis of said housing and coaxially disposed about said frame core portion below said upper flange, at least the upper flange of said electromagnetic frame including an opening extending upwardly therethrough, said continuous liquid path extending upwardly through the core of said bobbin via said electromagnetic frame tubular core portion and in parallel through said frame upper flange;

a valve seat operatively positioned in said valved path;

a valve member movable between a fuel-passing open position and a fuel-blocking closed position relative to said valve seat;

said armature being operatively connected to said valve member and responsive to energization of said electromagnetic motor means for moving said valve member between said closed and said open positions for controlling the flow of fuel to said discharge opening; and the location of said fuel return opening being elevationally higher than substantially the entire remainder of said continuous liquid path and said valved liquid path when said injector is in said predetermined orientation with said engine thereby to facilitate the removal from the injector of vapors appearing therewithin and wherein the slope of said continuous liquid path is, for substantially its full length and in the direction of flow toward said return opening, 0 or positive relative to a horizontal axis or plane.

2. The fuel injector of claim 1 wherein said valved liquid path and said continuous liquid path include a region of mutual coincidence, and the elevationally uppermost part of said region of coincidence is at least as high as the remainder of said valved liquid path.

3. The fuel injector of claim 2 including swirl imparting means positioned in said valved liquid path intermediate said valve seat and discharge opening for imparting a swirling motion to the fuel after it has passed said valve seat.

4. The fuel injector of claim 1 wherein said continuous liquid path and said valved liquid path are each sized and configured such that the flow of liquid in said continuous path with said valve closed is at least about 1.5–2 times that in said valved path with said valve in said open position.

5. the fuel injector of claim 4 wherein said armature substantially washer-shaped and is positioned below said bobbin and coil and includes an opening extending axially therethrough, and said continuous liquid path extends through said armature opening.

6. The fuel injector of claim 1 wherein said fuel return opening in said housing is at the upper end thereof in substantially coaxial alignment with said tubular bobbin of said electromagnetic motor means.

* * * * *